US008025767B2

(12) United States Patent
Krueger et al.

(10) Patent No.: US 8,025,767 B2
(45) Date of Patent: Sep. 27, 2011

(54) WET STRENGTH ENHANCERS FOR PAPER

(75) Inventors: Ellen Krueger, Otterstadt (DE); Martin Wendker, Worms (DE); Stefan Frenzel, Mannheim (DE); Claus Boettcher, Lambsheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 12/168,246

(22) Filed: Jul. 7, 2008

(65) Prior Publication Data

US 2009/0008051 A1 Jan. 8, 2009

Related U.S. Application Data

(63) Continuation of application No. 10/479,515, filed as application No. PCT/EP02/05900 on May 29, 2002, now abandoned.

(30) Foreign Application Priority Data

Jun. 11, 2001 (DE) ..... 101 27 829

(51) Int. Cl.
*D21H 17/45* (2006.01)
*D21H 21/20* (2006.01)

(52) U.S. Cl. ..... 162/164.3; 162/158; 162/164.1; 162/164.6; 162/168.1; 162/168.2; 162/185; 525/355

(58) Field of Classification Search ..... 162/164.1, 162/164.3, 168.1, 168.2, 166, 185; 524/556; 525/328.2, 355, 435, 436; 526/303.1, 307.1
See application file for complete search history.

(56) References Cited

U.S. PATENT DOCUMENTS

| | | | | |
|---|---|---|---|---|
| 2,926,116 | A | | 2/1960 | Geraldi |
| 2,926,154 | A | | 2/1960 | Keim |
| 3,250,664 | A | | 5/1966 | Conte et al. |
| 4,144,123 | A | | 3/1979 | Scharf et al. |
| 4,714,736 | A | | 12/1987 | Juhl et al. |
| 4,774,285 | A | | 9/1988 | Pfohl et al. |
| 4,880,497 | A | | 11/1989 | Hartmann et al. |
| 5,145,559 | A | | 9/1992 | Auhorn et al. |
| 5,334,289 | A | | 8/1994 | Trokhan et al. |
| 5,466,337 | A | | 11/1995 | Darlington et al. |
| 5,630,907 | A | | 5/1997 | Nilz et al. |
| 5,674,362 | A | | 10/1997 | Underwood |
| 5,695,609 | A | | 12/1997 | Duvnas et al. |
| 5,783,041 | A | | 7/1998 | Underwood |
| 6,048,945 | A | | 4/2000 | Denzinger et al. |
| 6,060,566 | A | | 5/2000 | Denzinger et al. |
| 6,083,348 | A | * | 7/2000 | Auhorn et al. ..... 162/183 |

FOREIGN PATENT DOCUMENTS

| | | |
|---|---|---|
| DE | 2 162 567 | 7/1972 |
| DE | 24 34 816 | 2/1976 |
| DE | 42 26 10 | 2/1994 |
| EP | 0 411 400 | 2/1991 |
| EP | 0 548 960 | 6/1993 |
| WO | 98 32798 | 7/1998 |
| WO | 98 36127 | 8/1998 |
| WO | 98/46828 | 10/1998 |

* cited by examiner

*Primary Examiner* — Eric Hug
*Assistant Examiner* — Dennis Cordray
(74) *Attorney, Agent, or Firm* — Oblon, Spivak, McClelland, Maier & Neustadt, L.L.P.

(57) ABSTRACT

They are mixtures of
(a) from 1 to 99.9% by weight of a water-soluble epihalohydrin-crosslinked polyamidoamine and
(b) from 0.1 to 20% by weight of at least one other cationic polymer.

7 Claims, No Drawings

WET STRENGTH ENHANCERS FOR PAPER

CROSS-REFERENCE TO RELATED-APPLICATIONS

This application is a continuation of U.S. Ser. No. 10/479,515 filed Dec. 10, 2003, abandoned, which was a national stage of PCT/EP02/05900 filed May 29, 2002 and claims the benefit of DE 101 27 829.2 filed Jun. 11, 2001.

The present invention relates to wet strength enhancers for paper and to a process for producing wet-strengthened enhanced paper.

U.S. Pat. No. 2,926,154 discloses water-soluble reaction products of an epihalohydrin and polyamidoamines. The, reaction products are used in papermaking by adding them to the paper stock as wet strength agents.

WO-A-98/32798 discloses a polymer combination prepared by crosslinking a polymer mixture of a polyamidoamine and a vinylamine polymer with an epihalohydrin. These reaction products are added to the paper stock in a papermaking process to add dry and wet strength to the paper.

U.S. Pat. No. 4,880,497 discloses copolymers which contain vinylamine units and which are formed by hydrolysis of copolymers of N-vinylformamide and other ethylenically unsaturated monomers. The copolymers containing vinylamine units are added to the paper stock in the papermaking process to enhance the dry and wet strength of paper.

The reaction products of the reaction of epihalohydrins with amino-containing compounds have the disadvantage of containing major amounts of chlorinous by-products.

It is an object of the present invention to provide improved wet strength enhancers for paper.

We have found that this object is achieved according to the invention by wet strength enhancers for paper, comprising mixtures of (a) from 1 to 99.9% by weight of a water-soluble epihalohydrin-crosslinked polyamidoamine and (b) from 0.1 to 20% by weight of at least one other cationic polymer from the group consisting of addition polymers containing vinylamine units, dicydicyandiamide-formaldehyde condensates.

Particular preference is given to wet strength enhancers comprising (a) a water-soluble epichlorohydrin-crosslinked polyamidoamine and (b) a 1-100 mol % hydrolyzed polyvinylformamide.

The invention also provides a process for producing paper by draining a paper stock in the presence of a wet strength enhancer, which comprises using wet strength enhancers comprising mixtures of (a) from 1 to 99.9% by weight of a water-soluble epihalohydrin-crosslinked polyamidoimine and (b) from 0.1 to 20% by weight of at least one other cationic polymer from the group consisting of addition polymers containing vinylamine units and dicdicyandiamide-formaldehyde condensates.

In this papermaking process the paper stock is admixed with (a) an epihalohydrin-crosslinked polyamidoamine and (b) at least one other cationic polymer concurrently or in any order, said components (a) and (b) being used in any event in a weight ratio of from 1 to 99.9:0.1 to 20.

The invention further provides for the use of the above-described wet strength enhancers in the making of paper by addition to the paper stock before sheet formation in amounts of from 0.1 to 4% by weight, based on dry fiber.

Component (a) of the paper wet strength enhancers according to the invention may be a water-soluble epihalohydrin-crosslinked polyamidoamine. Polyamidoamines may be prepared by condensation of dicarboxylic acids with polyalkylenepolyamines, cf. U.S. Pat. No. 2,926,154 and WO-A-98/32798. For example, from 0.8 to 1.4 mol of a polyalkylenepolyamine is used per mole of dicarboxylic acid.

Polyamidoamines are preferably prepared using aliphatic dicarboxylic acids having 2 to 10 carbon atoms, for example oxalic acid, malonic acid, succinic acid, maleic acid, glutaric acid, adipic acid, azelaic acid and lauric acid. Preferred dicarboxylic acids are adipic acid and glutaric acid.

Examples of polyalkylenepolyamines are diethylenetriamine, tripropylenetetramine, tetraethylenepentamine, methyl-bis-(3-aminopropyl)amine, diaminopropylethylenediamine, bisaminopropylethylenediamine and aminopropylethylenediamine. The condensation of dicarboxylic acids with polyalkylenepolyamines is effected at elevated temperature, for example at from 110 to 220° C. The water formed in the course of the condensation is distilled out of the reaction mixture. The condensation may also be effected in the presence of lactones or lactams of carboxylic acids having 4 to 8 carbon atoms. The reaction with epihalohydrins, preferably epichlorohydrin, is effected in aqueous solution at for example from 20 to 100° C., preferably from 30 to 80° C. The reaction of polyamidoamines with epihalohydrins is carried on only to that point at which the resultant reaction products remain dissolved in water. Once the viscosity of the reaction solution has attained the desired value, the reaction is terminated by addition of an acid, for example acetic acid or formic acid. This provides aqueous solutions of an epichlorohydrin-crosslinked polyamidoamine having a viscosity of for example from 50 to 2000 mPas, preferably from 60 to 400 mPas (determined in a Brookfield viscometer at 20° C., spindle 2, 20 revolutions per minute, concentration of the aqueous polymer solution: 12.5% by weight).

Useful cationic polymers may be derived for example from synthetic and natural cationic polymers. Useful natural polymers include for example cationic polysaccharides, cationic starch, cationic amylose and derivatives thereof, cationic amylopectin and derivatives thereof and also cationic guar derivatives.

Synthetic cationic polymers include for example polyethyleneimines. They may be prepared by polymerizing ethyleneimine in aqueous solution in the presence of acid-detaching compounds, acids or Lewis acids. Polyethyleneimines are commercially available and their molar masses range for example from 200 to 2 000 000, preferably from 200 to 1 000 00. The process of the invention particularly preferably utilizes polyethylenimines having molar masses from 500 to 800 000.

A further class of synthetic cationic compounds is that of the addition polymers containing vinylamine units. They may be prepared from open-chain N-vinylcarboxamides of the formula

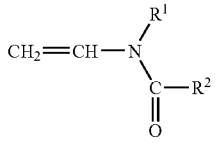

(I)

where $R^1$ and $R^2$ are identical or different and are each selected from-the group consisting of hydrogen and $C_1$-$C_6$-alkyl. Useful monomers include for example N vinylformamide ($R^1$=$R^2$=H in formula I), N-vinyl-N-methylformamide, N-vinylacetamide, N-vinyl N-methylacetamide, N-vinyl-N-ethylacetamide, N-vinyl-N-methylpropionamide and N-vinylpropionamide. The polymers may be prepared by polymerizing the monomers mentioned alone, mixed with each other or together with other monoethylenically unsaturated monomers. The addition polymers in question are preferably homo- or copolymers of N-vinylformamide. Useful monoethylenically unsaturated monomers for copolymerization with N-vinylcarboxamides include all compounds copolymerizable therewith. Examples thereof are vinyl esters of saturated carboxylic acids of 1 to 6 carbon atoms such as vinyl formate, vinyl acetate, vinyl propionate and vinyl butyrate. Useful comonomers further include ethylenically unsaturated $C_3$-$C_6$-carboxylic acids, for example acrylic acid, methacrylic acid, maleic acid, crotonic acid, itaconic acid and vinyl ester acid and also their alkali metal and alkaline earth metal salts, esters, amides and nitriles of the carboxylic acids mentioned, for example methyl acrylate, methyl methacrylate, ethyl acrylate and ethyl methacrylate. Further, useful carboxylic esters are derived from glycols or polyalkylene glycols where in each case only one OH group is esterified, for example hydroxyethyl acrylate, hydroxyethyl methacrylate, hydroxypropyl acrylate, hydroxybutyl acrylate, hydroxypropyl methacrylate, hydroxybutyl methacrylate and also monoacrylate esters of polyalkylene glycols having a molar mass of from 500 to 10 000. Useful comonomers further include esters of ethylenically unsaturated carboxylic acids with aminoalcohols, for example dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate and diethylaminobutyl acrylate. Basic acrylates can be used in the form of the free bases, salts with mineral acids such as hydrochloric acid, sulfuric acid or nitric acid, the salts with organic acids such as formic acid, acetic acid, propionic acid or of sulfonic acids or in quaternized form. Useful quaternizing agents include for example dimethyl sulfate, diethyl sulfate, methyl chloride, ethyl chloride or benzyl chloride.

Useful comonomers for the monomers of the formula I further include amides of ethylenically unsaturated carboxylic acids such as acrylamide, methacrylamide and also N-alkylmonoamides and diamides of monoethylenically unsaturated carboxylic acids with alkyl radicals of from 1 to 6 carbon atoms, for example N-methylacrylamide, N,N-dimethylacrylamide, N-methylmethacrylamide, N-ethylacrylamide and N-propylacrylamide and tert-butylacrylamide and also basic (meth)acrylamides, for example dimethylaminoethylacrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Useful comonomers for the monomers of the formula I further include N-vinylpyrrolidone, N-vinylcaprolactam, acrylonitrile, methacrylonitrile, N-vinylimidazole and also substituted N-vinylimidazoles, for example N-vinyl-2-methylimidazole, N-vinyl-4-methylimidazole, N-vinyl-5-methylimidazole, N-vinyl-2-ethylimidazole and N-vinylimidazolines such as N-vinylimidazoline, N-vinyl-2-methylimidazoline and N-vinyl-2-ethylimidazoline. N-vinylimidazoles and N-vinylimidazolines are used not only in the form of the free bases but also after neutralization with mineral acids or organic acids or after quaternization, a quatemization being preferably effected with dimethyl sulfate, diethyl sulfate, methyl chloride or benzyl chloride. Also useful are diallyldialkylammonium halides, for example diallyldimethylammonium chlorides.

Useful comonomers for N-vinylcarboxamides further include sulfo-containing monomers, for example vinylsulfonic acid, allylsulfonic acid, methallylsulfonic acid, styrenesulfonic acid, the alkali metal or ammonium salts of these acids or 3-sulfopropyl acrylate.

The copolymers contain for example from 99.99 to 1 mol % of N-vinylcarboxamides of the formula I and from 1 to 99 mol % of other monoethylenically unsaturated monomers copolymerizable therewith in copolymerized form.

To prepare vinylamine polymers it is preferable to start from homopolymers of N-vinylformamide or from copolymers obtainable by copolymerization of N-vinylformamide with vinyl formate, vinyl acetate, vinyl propionate, acrylonitrile or N-vinylpyrrolidone and subsequent hydrolysis of the homo- or copolymers to form vinylamine units from the copolymerized N-vinylformamide units, the degree of hydrolysis being for example in the range from 1 to 100 mol %. For instance, polyvinylamine is obtained by complete hydrolysis (degree of hydrolysis 100 mol %) of homopolymers of N-vinylformamide.

The hydrolysis of the above-described polymers is effected according to known processes by the action of acids, bases or enzymes. This converts the copolymerized monomers of the above-indicated formula I through detachment of the group

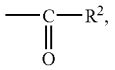

(II)

where $R^2$ is as defined for formula I, into polymers which contain vinylamine units of the formula

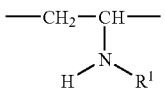

(III)

where $R^1$ is as defined for formula I.

The homopolymers of the N-vinylcarboxamides of the formula I and their copolymers may be hydrolyzed to an extent in the range from 1 to 100 mol %, advantageously to an extent in the range from 5 to 100 mol %, preferably to an extent in the range from 10 to 100 mol %. In most cases, the degree of hydrolysis of the homo- and copolymers is in the range from 20 to 95 mol %. The degree of hydrolysis of the homopolymers is synonymous with the vinylamine units content of the polymers. In the case of copolymers containing units derived from vinyl esters, the hydrolysis of the N-vinylformamide units can be accompanied by a hydrolysis of the ester groups with the formation of vinyl alcohol units. This is the case especially when the hydrolysis of the copolymers is carried out in the presence of aqueous sodium hydroxide solution. Copolymerized acrylonitrile is likewise chemically modified in the hydrolysis, for example converted into amide groups or carboxyl groups. The homo- and copolymers containing vinylamine units may optionally contain up to 20 mol % of amidine units, formed for example by intramolecular reaction of an amino group with an adjacent amide group, for example of copolymerized N-vinylformamide.

Polymers containing vinylamine units also include hydrolyzed graft polymers of N-vinylformamide on polysaccharides, polyalkylene glycols and polyvinyl acetate. The N-vinylformamide units grafted onto the polymers are converted into the corresponding addition polymers containing vinylamine units by hydrolysis to detach formyl groups. Graft polymers containing vinylamine units are described for example in U.S. Pat. Nos. 5,334,287, 6,048,945 and 6,060,566.

In an embodiment of the present invention, the cationic polymers are used in the form of salt-free aqueous solutions or low-salt aqueous solutions containing not more than 5% by weight and preferably not more than 2% by weight of an inorganic salt. Such salt-free or low-salt solutions may be prepared by ultrafiltration or by precipitation of the neutral salts with organic solvents such as acetone, methyl ethyl ketone or alcohols.

Preferred cationic polymers are addition polymers containing vinylamine units.

The molar mass $M_w$ of the cationic polymers is not less than 15 00 and is preferably in the range from 50 000 to 10 million. The molar mass $M_w$ of the cationic polymers is determined by light scattering. The cationic polymers may have a charge density of at least 1.5 and preferably from 4 to 15 meq/g (measured at pH 7).

Useful fibers for producing the pulps include all types customary for this purpose, for example mechanical pulp, bleached and unbleached chemical pulp and paper stocks from all annual plants. Mechanical pulp includes for example groundwood pulp, thermomechanical pulp (TMP), chemothermomechanical pulp (CTMP), pressure groundwood, semichemical pulp, high yield chemical pulp and refiner mechanical pulp (RMP). Useful chemical pulps include for example sulfate, sulfite and soda pulps. Preference is given to using unbleached chemical pulps, which is also known as unbleached kraft pulp. Useful annual plants for producing paper stocks include for example rice, wheat, sugarcane and kenaf. Pulps are also produced using waste paper alone or mixed with other fibers. Waste paper also includes coated waste, which, owing to its binder content for coating and printing ink compositions, gives rise to white pitch. Stickies are due to the adhesives from sticky labels and letter envelopes, due to adhesive materials from spine gluing and due to hotmelts. The fibers mentioned may be used alone or mixed with each other.

The inventive wet strength enhancers comprised of components (a) and (b) contain for example from 0.1 to 20% and preferably from 0.2 to 5% by weight of a cationic natural and/or synthetic polymer. The wet strength enhancers are added to the paper stock in the papermaking process in amounts from 0.1 to 5% by weight, preferably from 0.5 to 4% by weight, each percentage being based on dry fiber. However, components (a) and (b) can also be added separately to the paper stock in the papermaking process in the above-described ratio. It is possible, for instance, first to add component (a) to the paper stock and then to add component (b) just ahead of the headbox for example. However, the order of the components can also be reversed and similarly the two components can also be added concurrently through a two-material nozzle or through two separately disposed metering positions, to the paper stock.

Whereas the wet strength of paper cannot be increased to beyond a certain value by raising the amount of a customary wet strength agent, for example an epichlorobydrin-crosslinked polyamidoamine as per component (a), which is added to the paper stock, the wet strength enhancer of the invention provides a further increase in the wet strength of the paper.

The percentages in the examples are by weight. The wet breaking length was determined according to DIN ISO 3781 following a 15 minute immersion in water.

EXAMPLES

The stock model used was a 3.3 g/l consistency pulp of 100% bleached pine sulfate beaten to 32° SR and having a pH of 7.1. Samples of this pulp were each admixed with the wet strength agents reported in Table 1 and the mixture obtained in each case was drained on a Rapid-Köthen sheet former. The basis weight of the sheets of paper was 55 g/m$^2$ in each case. The sheets were stored at 110° C. for 5 minutes. The wet tensile strength of the sheets was then determined by the method indicated above. The materials used and the results obtained therewith are reported in the table.

Wet strength agent 1: commercially available water-soluble epichlorohydrin-crosslinked polyamidoamine (Luresin® KNU), polymer concentration 13.5% by weight Wet strength agent 2: commercially available water-soluble epichlorohydrin-crosslinked polyamidoamine (Kymene® G 3), polymer concentration 16% by weight PVAm: aqueous solution of polyvinylamine having a molar mass Mw of 400 000 g/mol, polymer concentration 11.8% by weight Wet breaking length [m] on use of wet strength agent 1, 2 or PVAm

| | Addition to paper stock | Wet strength agent 1 | Wet strength agent 2 | PVAm |
|---|---|---|---|---|
| Comparison 1 | 2% of CP[1)] | 912 m | 872 m | 480 m |
| Comparison 2 | 5% of CP | 1550 m | 1492 m | 1328 m |
| Comparison 3 | 10% of CP | 2165 m | 1935 m | 1459 m |
| Example 1 | 5% of CP + 2% of PVAm | 2161 m | 2094 m | — |
| | | | | — |

[1)]CP = commercial product

We claim:

1. A wet strength enhancer suitable for paper, comprising (a) from 1 to 99.9% by weight of an epihalohydrin-crosslinked polyamidoamine and (b) from 0.1 to 20% by weight of a cationic polyvinylamine having a molecular mass of 400,000 g/mol.

2. A process for producing paper which comprises adding to a paper stock a wet strength enhancer, which comprises (a) from 1 to 99.9% by weight of an epihalohydrin-crosslinked polyamidoamine and (b) from 0.1 to 20% by weight of a cationic polyvinylamine having a molecular mass of 400,000 g/mol; and draining the paper stock to produce paper.

3. The process as claimed in claim 2, wherein (a) and (b) are in a weight ratio of from 1 to 0.1 to 5 to 2.

4. Paper, comprising: 0.1 to 4% by weight of the composition as claimed in claim 1, based on dry fiber of a paper stock.

5. The process as claimed in claim 3, wherein (a) and (b) are added concurrently to the paper stock.

6. The process as claimed in claim 3, wherein (a) is added to the paper stock before (b).

7. The process as claimed in claim 3, wherein (b) is added to the paper stock before (a).

* * * * *